US011426751B2

(12) United States Patent
Robinson

(10) Patent No.: US 11,426,751 B2
(45) Date of Patent: Aug. 30, 2022

(54) PORTABLE JOBSITE SPRAY BOOTH

(71) Applicant: Kyle Robinson, Menlo Park, CA (US)

(72) Inventor: Kyle Robinson, Menlo Park, CA (US)

( * ) Notice: Subject to any disclaimer, the term of this patent is extended or adjusted under 35 U.S.C. 154(b) by 297 days.

(21) Appl. No.: 16/843,383

(22) Filed: Apr. 8, 2020

(65) Prior Publication Data

US 2020/0230638 A1 Jul. 23, 2020

(51) Int. Cl.

*B05B 16/80* (2018.01)
*B05B 16/60* (2018.01)
*B05B 16/40* (2018.01)

(52) U.S. Cl.

CPC ..... *B05B 16/80* (2018.02); *B05B 16/40* (2018.02); *B05B 16/60* (2018.02)

(58) Field of Classification Search

USPC ..... 118/309, 326, 634
See application file for complete search history.

(56) References Cited

U.S. PATENT DOCUMENTS 3,614,068 A * 10/1971 Koehl ..... E04F 11/181 256/19
2003/0074845 A1* 4/2003 Sample ..... E04H 15/50 52/63
2009/0283031 A1* 11/2009 Grasso ..... B05B 15/80 118/104
2016/0258182 A1* 9/2016 Xie ..... E04H 15/54
2020/0102766 A1* 4/2020 Carter ..... E04H 15/16

FOREIGN PATENT DOCUMENTS

DE 294314 A * 9/1991

* cited by examiner

*Primary Examiner* — Yewebdar T Tadesse

(57) ABSTRACT

Disclosed is a portable jobsite spray booth for painting, drying, finishing, routing, sanding, sawing, and processing an object and protecting the processed object. The portable jobsite spray booth includes a plurality of bases, a plurality of first connectors, a plurality of second connectors, a plurality of vertical poles, and a plurality of horizontal poles. A disposable plastic liner is used for covering five sides of the portable jobsite spray booth with one side open. The disposable 5-sided clear plastic liner provides overspray and particulate protection to and from the ceiling, floor, and three sides. The portable jobsite spray booth is provided with a ventilation attachment that accommodates air filter, ducting and blower system.

18 Claims, 15 Drawing Sheets

PORTABLE JOBSITE SPRAY BOOTH

FIELD OF THE INVENTION

The present invention relates generally to painting, finishing, drying, and particulate containment tools, and, more particularly, to a portable jobsite spray booth for painting, finishing, routing, sanding, sawing, processing, and drying an object where that is necessary.

BACKGROUND

Generally, painting, finishing, routing, sanding, and sawing and other processes may be performed inside a building or protective structure to prevent wind from causing uneven application and to shelter wet or clean surfaces from debris, dust, and insects. Ordinarily, some of the particulate released from equipment such as compressed air sprayers, airless sprayers, aerosol cans, rollers, brushes or other tools misses the object being processed or results from the tool being used on the object. Masking materials such as tarps, tape, masking paper, rags, scrap packaging, or building materials may be used to prevent paint overspray or other particulate from falling on room surfaces and other items near an object being worked on or processed. It can be time consuming to find masking materials and to construct an overspray or protective barrier at each new jobsite, especially when processing or working on multiple objects such as cabinet doors and drawers or on individually large objects such as building doors.

The portable jobsite spray booth provides a means whereby an operator may perform painting, finishing, routing, sanding, and sawing and other processes on the object without contaminating himself or the surroundings immediately outside the booth with atomized liquids such as paints, enamels, lacquers, or the like or release particulate or the objectionable odor generally associated with the aforementioned atomized liquids into the atmosphere surrounding the booth. In addition, the object as it is being processed and after it has been processed is protected by the booth from deleterious agents present in air, such as dust and other solid objects found floating in the air. The adhering of these deleterious agents to a newly painted, finished, or processed surface of the object may cause the purpose for which the object was processed to be destroyed or seriously undermined. The drying of paint or finish on the object within a controlled environment also enables the surface to be accomplished more rapidly than possible in an uncontrolled environment. The portable jobsite spray booth is fabricated so as to be collapsible for facilitating transportation or storage of the booth minimizing the amount of space needed to transport or store the booth.

Though various types of spray booths and other work tents are already available in the market, the objective of the present invention is to provide an advanced and easy-to-use portable jobsite spray booth that is easy to install and break down or collapse as per the user's requirement.

BRIEF SUMMARY

It is an objective of the present invention to provide a portable jobsite spray booth. The portable jobsite spray booth may be used for painting, finishing, routing, sanding, and sawing and performing other processes on an object and drying or protecting the processed object. The portable jobsite spray booth is a portable, transparent, and disposable open-faced spray booth designed for quick no tools assembly at a work site or workplace. The portable jobsite spray booth is a 5-sided structure that may be assembled indoors or outdoors in a few minutes. Aluminum extrusions connect to form the base of the portable jobsite spray booth. Aluminum tent poles support a disposal, translucent, plastic, 5-sided cube that allows light to come through to illuminate the workspace. The portable jobsite spray booth has been designed for working with non-flammable vapors. Filtration and ventilation may be attached to the back of the portable jobsite spray booth. Exhaust blowers may then be attached via ducting to pull air through the portable jobsite spray booth and through a filter.

In an embodiment, the portable jobsite spray booth includes a plurality of bases, a plurality of first connectors, a plurality of second connectors, a plurality of vertical poles, a plurality of first type of horizontal poles, and a plurality of second type of horizontal poles. Each pair of the plurality of bases are connected to each other at a right angle by using a first connector of the plurality of first connectors. Each vertical pole of the plurality of vertical poles is connected to at least one of a respective first connector of the plurality of first connectors or a respective second connector of the plurality of second connectors. Each of the plurality of first type of horizontal poles and each of the plurality of second type of horizontal poles are connected to a top end of each of plurality of vertical poles by means of a magnetic mechanism. Further, a length of the plurality of first type of horizontal poles is greater than a length of the plurality of second type of horizontal poles. Further, a disposable plastic liner is used for covering five sides of the portable jobsite spray booth with one side open.

In an embodiment, each base includes a rectangular hollow path for placing at least one of the plurality of first connectors and the plurality of second connectors. Each first connector is a removable fastener or bracket that is used to connect two bases of the portable jobsite spray booth at their edges in a L-shaped manner. Each first connector includes two circular holes that are used for fastening two bases together by means of a nut-bolt assembly. Each first connector includes a pipe connector that is used for connecting each vertical pole of the plurality of vertical poles. Each first connector includes two base fixing components that protrude inward below a L-shaped base of each first connector, wherein the two base fixing components are used for removably securing two bases of the portable jobsite spray booth. Each second connector includes a circular hole that is used for fastening each second connector with a respective base of the portable jobsite spray booth by means of a nut-bolt assembly. Each second connector includes two base fixing components that protrude inward below a rectangular base of each second connector. The two base fixing components are used for removably securing each second connector along a rectangular hollow path of a base of the portable jobsite spray booth.

In an embodiment, the portable jobsite spray booth further comprises a vent assembly that includes a duct attachment, a filter holder, a filter, and a vent window. The vent assembly facilitates filtration and ventilation to the portable jobsite spray booth and provides a ventilation attachment that accommodates the air filter, ducting and blower system. Magnets and sealing strips are glued in place on the duct attachment, and the duct attachment bolts to an aluminum extrusion with threaded tabs. The steel filter holder snaps in place to the magnets trapping the plastic liner. The circular neodymium magnets are provided in the corners and rubber seal strips are provided between the magnets to properly seal the connection.

In an embodiment, the magnetic mechanism is implemented by using a neodymium magnet that is attached to top of each vertical pole of the plurality of vertical poles. Each of the horizontal poles includes steel balls on each end that snap to the magnet and break away when stressed. The disposable plastic liner is used to protect a jobsite while spraying non-flammable and non-combustible finishes. The disposable plastic liner provides overspray protection as well as work object protection to and from ceiling, floor, and three sides of a workspace.

In an embodiment, the vertical poles and horizontal poles are aluminum tent poles that support the disposable plastic liner. The aluminum poles slide through hems that are outside the disposable plastic liner so that the disposable plastic liner is completely enclosed and doesn't allow particulate to contaminate the workspace or external particulate to contaminate the work object.

These and other features and advantages along with other embodiments of the present invention will become apparent from the detailed description below, in light of the accompanying drawings.

BRIEF DESCRIPTION OF THE ACCOMPANYING DRAWINGS

The novel features which are believed to be characteristic of the present disclosure, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this disclosure will now be described by way of example in association with the accompanying drawings in which:

Figure 1:
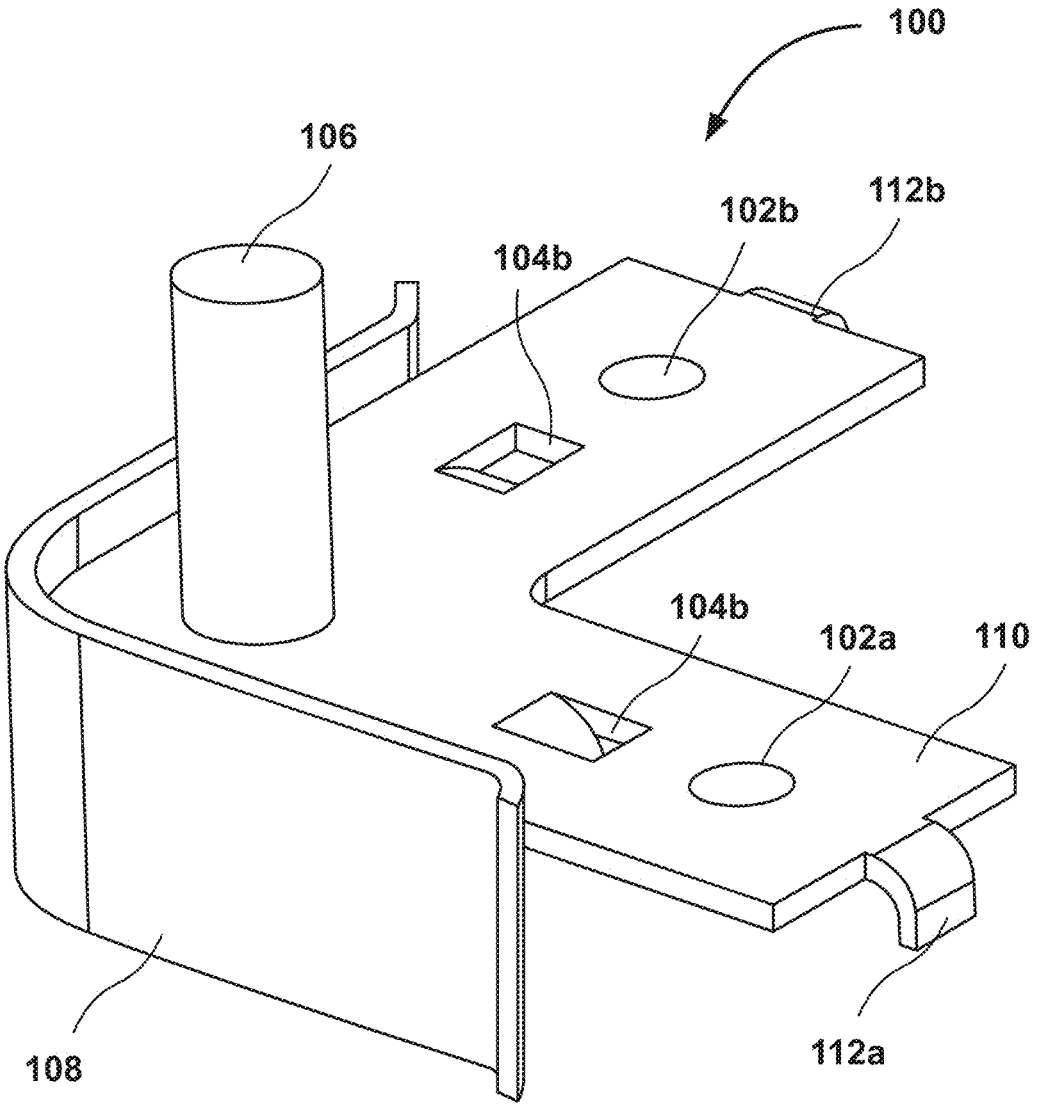
FIG. 1 shows a first connector of the portable jobsite spray booth, in accordance with an embodiment of the present invention.

Further areas of applicability of the present invention will become apparent from the detailed description provided hereinafter. It should be understood that the detailed description of exemplary embodiments is intended for illustration purposes only and is, therefore, not intended to necessarily limit the scope of the invention.

DETAILED DESCRIPTION

As used in the specification and claims, the singular forms "a", "an" and "the" may also include plural references. For example, the term "an article" may include a plurality of articles. Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention. There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of mechanical components, which constitutes a portable, transparent, and disposable open-faced portable jobsite spray booth. Accordingly, the components have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

References to "one embodiment", "an embodiment", "another embodiment", "yet another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

The words "comprising," "having," "containing," and "including," and other forms thereof, are intended to be equivalent in meaning and be open ended in that an item or items following any one of these words is not meant to be an exhaustive listing of such item or items or meant to be limited to only the listed item or items.

Techniques consistent with the present invention provide, among other features, the portable, transparent, disposable open-faced portable jobsite spray booth that is designed for quick no tools assembly at a work site for processing an object and protecting the processed object. The processing of the object may include one or more of, but are not limited to, painting, drying, finishing, routing, sanding, and sawing. Unless stated otherwise, terms such as "first" and "second" are used to arbitrarily distinguish between the elements such terms describe. Thus, these terms are not necessarily intended to indicate temporal or other prioritization of such elements. While various exemplary embodiments of the disclosed system and method have been described above it should be understood that they have been presented for purposes of example only, not limitations. It is not exhaustive and does not limit the invention to the precise form disclosed. Modifications and variations are possible in light of the above teachings or may be acquired from practicing of the invention, without departing from the breadth or scope.

The portable jobsite spray booth will now be described with reference to the accompanying drawings which should be regarded as merely illustrative without restricting the scope and ambit of the disclosure.

FIG. 1 shows a first connector 100 of a portable jobsite spray booth, in accordance with an embodiment of the present invention. The portable jobsite spray booth has been designed for quick no tools assembly at a work site for processing an object and protecting the processed object. The processing of the object may include one or more of, but are not limited to, painting, drying, finishing, routing, sanding, and sawing.

In an embodiment, the first connector 100 is removable fastener or bracket that is used to connect two bases of the portable jobsite spray booth at their edges in a L-shaped manner. In an embodiment, the first connector 100 is L-shaped fastener or bracket as shown in FIG. 1. The first connector 100 includes two circular holes such as a first circular hole 102*a* and a second circular hole 102*b*. The first circular hole 102*a* and the second circular hole 102*b* are used for fastening the bases together by means of a nut-bolt assembly. The first connector 100 further includes two rectangular holes such as a first rectangular hole 104*a* and a second rectangular hole 104*b*. These holes 104*a* and 104*b* may be square holes as well. The first connector 100 further includes a pipe connector 106 that is used for removably connecting or attaching a vertical pipe of the portable jobsite spray booth. The first connector 100 further includes a L-shaped cover 108 that covers an outer vertical portion of the first connector 100 as shown in FIG. 1. Two edges of the L-shaped cover 108 protrude outwards away from a L-shaped base 110 of the first connector 100 as shown in FIG. 1. The first connector 100 further includes two base fixing components such as a first base fixing component 112*a* and a second base fixing component 112*b* that protrude inward below the L-shaped base 110 of the first connector 100 as shown in FIG. 1. The first base fixing component 112*a* and the second base fixing component 112*b* are used for removably securing two bases of the portable jobsite spray booth.

Figure 2:
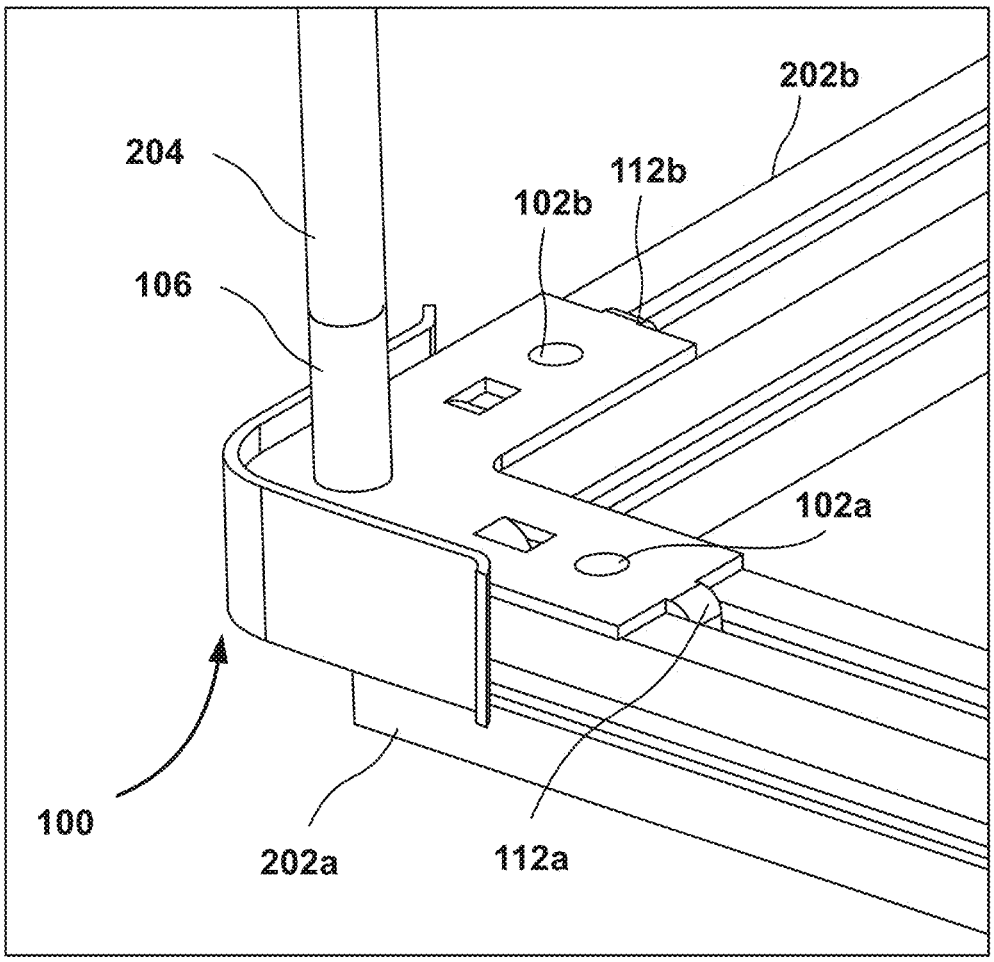
FIG. 2 shows the first connector that connects two bases of the portable jobsite spray booth, in accordance with an embodiment of the present invention.

FIG. 2 shows the first connector 100 that connects two bases 202*a* and 202*b* of the portable jobsite spray booth, in accordance with an embodiment of the present invention. The bases 202*a* and 202*b* are removably secured by using the first base fixing component 112*a* and the second base fixing component 112*b* of the first connector 100. Thereafter, a first nut-bolt is used in the first circular hole 102*a* and a second nut-bolt is used in the second circular hole 102*b* to fasten the first connector 100 with the bases 202*a* and 202*b*. The bases 202*a* and 202*b* are arranged in a L-shaped manner such that the first base fixing component 112*a* and the second base fixing component 112*b* are placed into a first rectangular hollow path and a second rectangular hollow path of the bases 202*a* and 202*b*, respectively, as shown in FIG. 2. Further, a vertical pole 204 of the portable jobsite spray booth is removably attached to the pipe connector 106.

Figure 3:
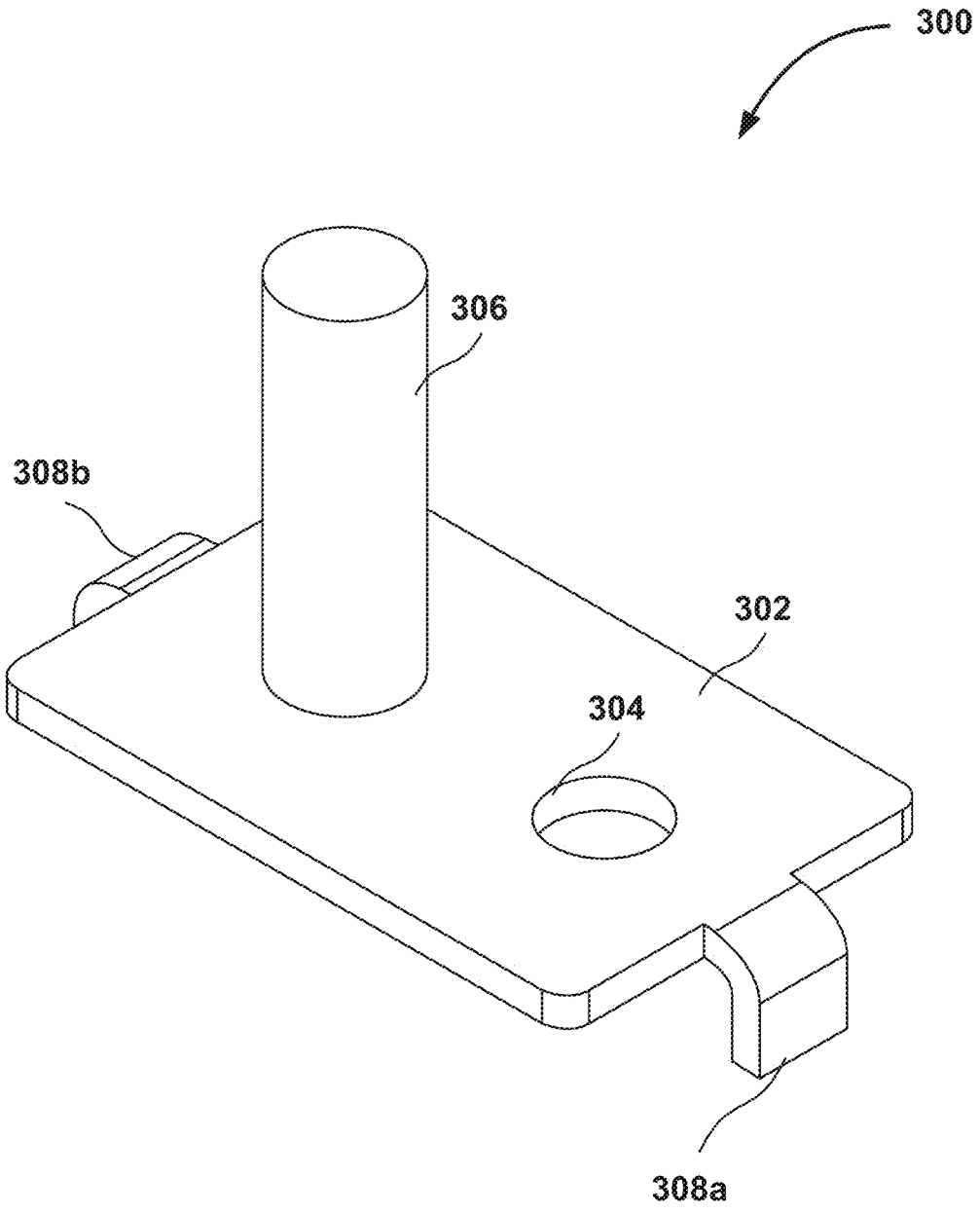
FIG. 3 shows a second connector of the portable jobsite spray booth, in accordance with an embodiment of the present invention.

FIG. 3 shows a second connector 300 of the portable jobsite spray booth, in accordance with an embodiment of the present invention. The portable jobsite spray booth has been designed for quick no tools assembly at a work site for processing an object and protecting the processed object. The processing of the object may include one or more of, but are not limited to, painting, drying, finishing, routing, sanding, and sawing.

In an embodiment, the second connector 300 is removable fastener or bracket that is used to connect a vertical pipe with a base of the portable jobsite spray booth. In an embodiment, the second connector 300 is rectangular-shaped fastener or bracket as shown in FIG. 1. The second connector 300 includes a rectangular base 302 (or a square base). The rectangular base 302 includes one circular hole such as a first circular hole 304. The first circular hole 304 is used for fastening the second connector 300 with the base of the portable jobsite spray booth by means of a nut-bolt assembly. The second connector 300 further includes a pipe connector 306 that is attached to the rectangular base 302. The second connector 300 further includes two base fixing components such as a first base fixing component 308*a* and a second base fixing component 308*b* that protrude inward below the rectangular base 302 of the second connector 300 as shown in FIG. 3. The first base fixing component 308*a* and the second base fixing component 308*b* are used for removably securing the second connector 300 along a rectangular hollow path of the base of the portable jobsite spray booth.

Figure 4:
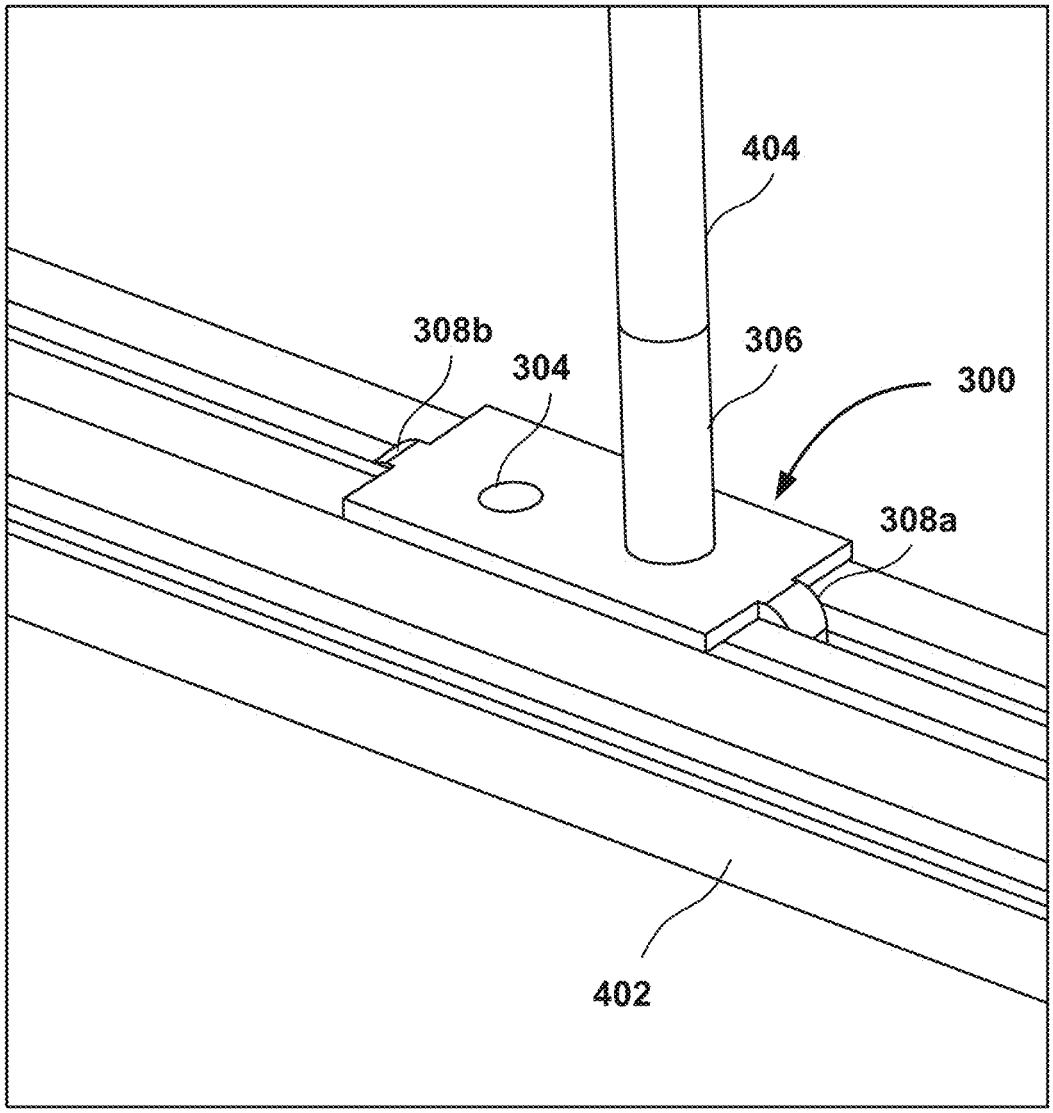
FIG. 4 shows the second connector that connects a vertical pole to a base of the portable jobsite spray booth, in accordance with an embodiment of the present invention.

FIG. 4 shows the second connector 300 that connects a vertical pole 404 to a base 402 of the portable jobsite spray booth, in accordance with an embodiment of the present invention. The bases 402 is removably secured by using the first base fixing component 308*a* and the second base fixing component 308*b* of the second connector 300. Thereafter, a first nut-bolt is used in the first circular hole 304 to fasten the second connector 300 with the base 402. The first base fixing component 308*a* and the second base fixing component 308*b* are placed into a rectangular hollow path of the base 402, as shown in FIG. 4. Further, the vertical pole 404 of the portable jobsite spray booth is removably attached to the pipe connector 306. Such connection mechanism may be realized or implemented by using a screw, nut-bolt, or magnetic mechanism.

Figure 5:
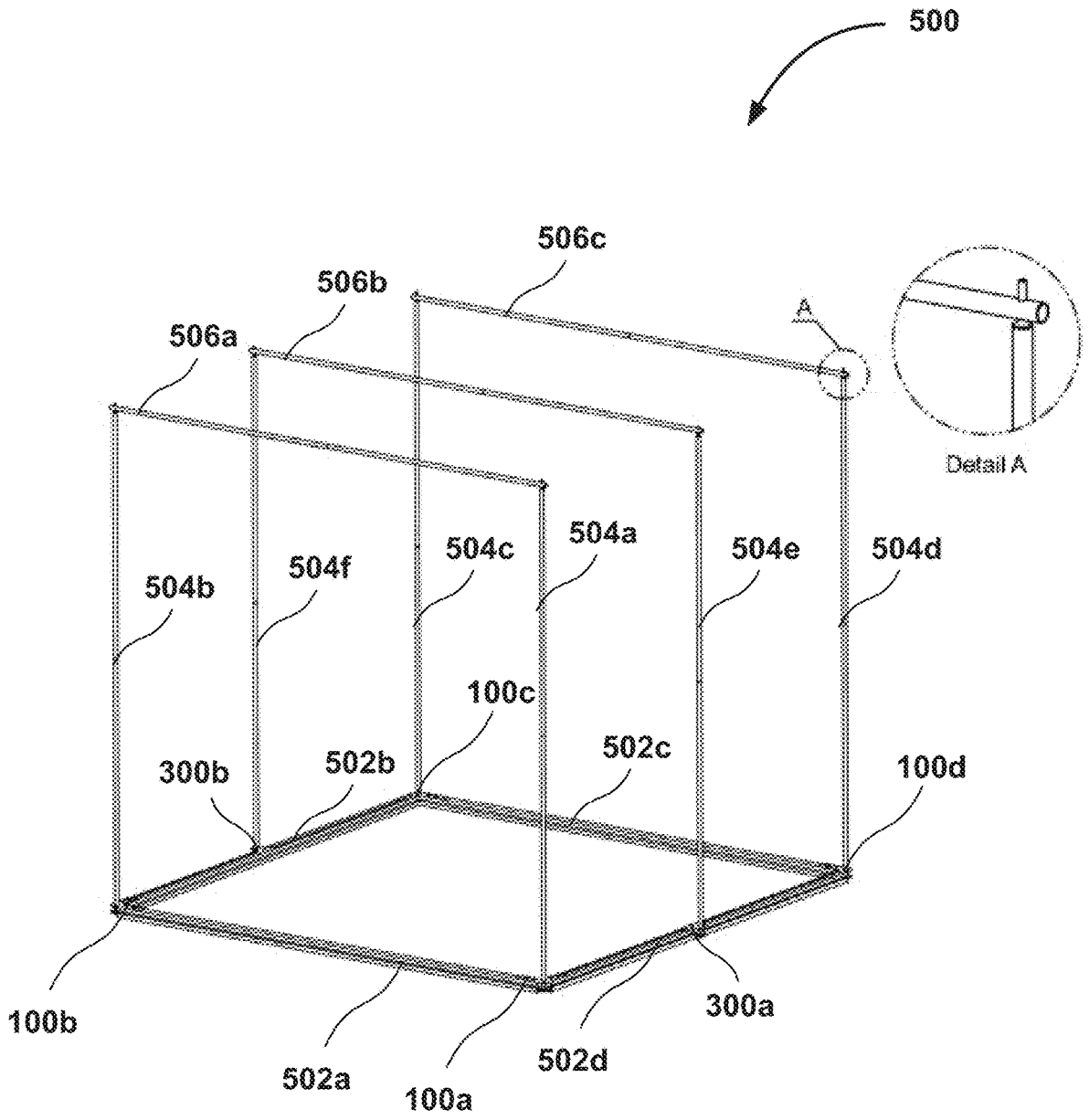
FIG. 5 shows assembly of the portable jobsite spray booth, in accordance with an embodiment of the present invention.

FIG. 5 shows an assembly of the portable jobsite spray booth 500, in accordance with an embodiment of the present invention. The portable jobsite spray booth 500 has been designed for quick no tools assembly at a work site for processing an object and protecting the processed object. The processing of the object may include one or more of, but are not limited to, painting, drying, finishing, routing, sanding, and sawing. In an embodiment, the portable jobsite spray booth 500 includes various components such as first connectors 100*a*-100*d*, second connectors 300*a*-300*b*, bases 502*a*-502*d*, vertical poles 504*a*-504*f*, and horizontal poles 506*a*-506*c* that are assembled together to form the portable jobsite spray booth 500. Here, the first connector 100*a* is used to connect the bases 502*a* and 502*d*, the first connector 100*b* is used to connect bases 502*a* and 502*b*, the first connector 100*c* is used to connect bases 502*b* and 502*c*, and the first connector 100*d* is used to connect bases 502*c* and 502*d*. The bases 502*a*-502*d* are removably connected by using the first connectors 100*a*-100*d* such that the bases 502*a*-502*d* form a square or rectangular surface base. When all the bases 502*a*-502*d* are of equal length, then a square surface base is formed. When the bases 502*a* and 502*c* are of equal length and the bases 502*b* and 502*d* are of equal length, but the length of the bases 502*a* and 502*c* is different from the length of the bases 502*b* and 502*d*, then a rectangular surface base is formed.

Further, the vertical poles 504*a*-504*d* are connected to the first connectors 100*a*-100*d*. For example, the vertical pole 504*a* is connected to the first connector 100*a*, the vertical pole 504*b* is connected to the first connector 100*b*, the vertical pole 504*c* is connected to the first connector 100*c*, and the vertical pole 504*d* is connected to the first connector 100*d*. Similarly, the vertical pole 504*e* is connected to the second connector 300*a* and the vertical pole 504*f* is connected to the second connector 300*b*. Further, as shown in FIG. 5, each of the vertical poles 504*a*-504*f* may include a single-pole joint having a single pole. The horizontal poles 506*a*-506*c* are connected to the vertical poles 504*a*-504*f* by using the single-pole joints of the vertical poles 504*a*-504*f*. For example, the horizontal pole 506*a* is connected to the vertical poles 504*a* and 504*b* by using the single-pole joints of the vertical poles 504*a* and 504*b*, as shown in FIG. 5. Similarly, the horizontal pole 506*b* is connected to the vertical poles 504*e* and 504*f* by using the single-pole joints of the vertical poles 504*e* and 504*f* and the horizontal pole 506*c* is connected to the vertical poles 504*c* and 504*d* by using the single-pole joints of the vertical poles 504*c* and 504*d*.

In an embodiment, aluminum extrusions connect to form the bases 502*a*-502*d* of the portable jobsite spray booth 500. Aluminum tent poles (such as the vertical poles 504*a*-504*f* and horizontal poles 506*a*-506*c*) support a plastic frame (i.e., a disposal translucent plastic 5-sided cube liner) that allows light to come through to illuminate a workspace. The portable jobsite spray booth 500 has been designed for working with non-flammable vapors and other particulates. Filtration and ventilation can be attached to the back of the portable jobsite spray booth 500. Exhaust blowers can then be attached via ducting to pull air through the portable jobsite spray booth 500 and through a filter. The aluminum poles slide through hems that are outside the plastic cube so that the plastic cube is completely enclosed and doesn't allow particulate to contaminate the workspace or the fixture. In an exemplary embodiment, the portable jobsite spray booth 500 is 2 m×2 m×2 m 5-sided structure that can be assembled indoors in minutes.

Figure 6:
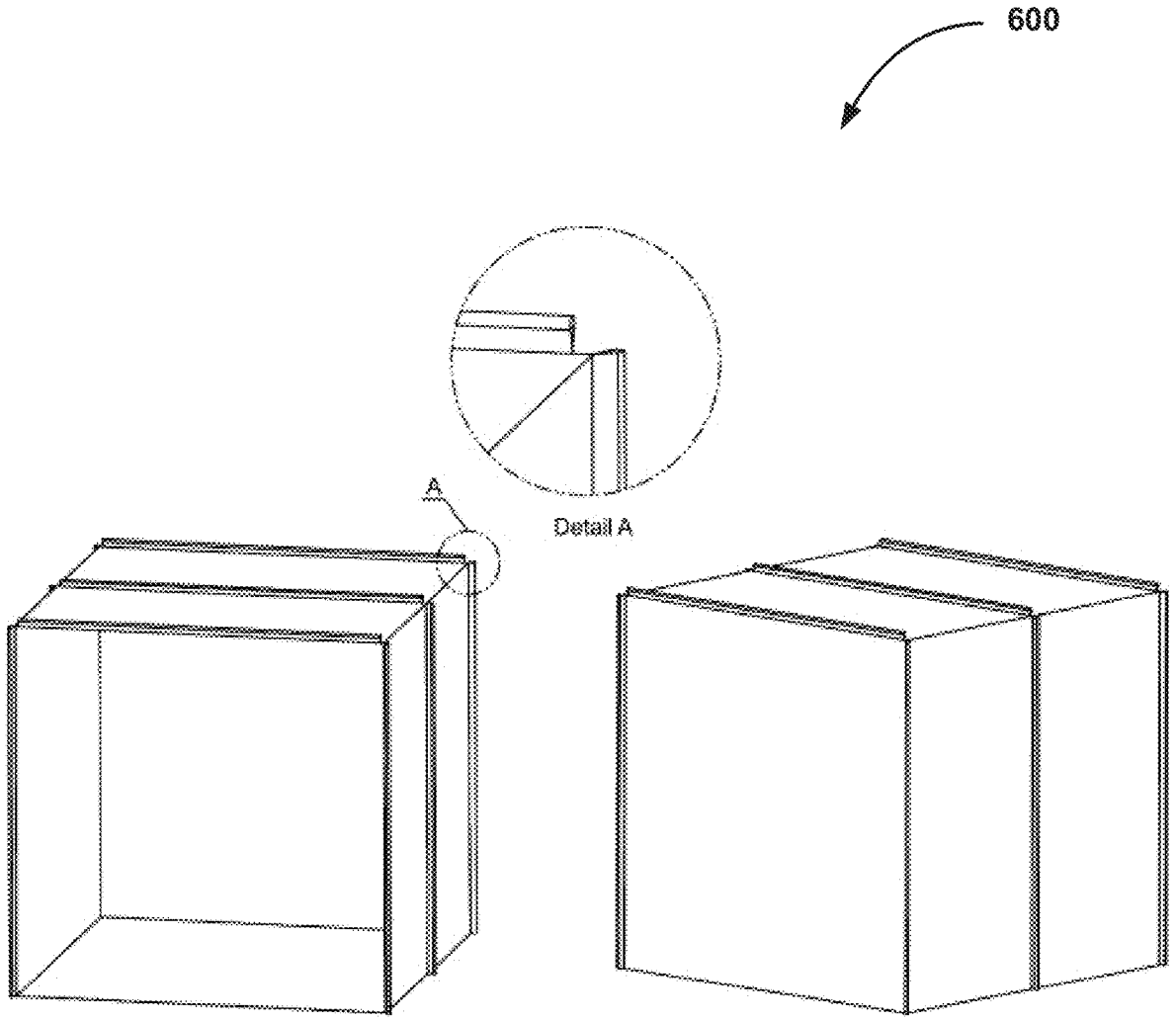
FIG. 6 shows assembly of the portable jobsite spray booth, in accordance with another embodiment of the present invention.

FIG. 6 shows an assembly of the portable jobsite spray booth 600, in accordance with another embodiment of the present invention. The assembly of the various components is similar to as described above with respect to FIG. 5. The only difference in this embodiment is that each of the vertical poles 504*a*-504*f* does not include the single-pole joint. Instead, each of the vertical poles 504*a*-504*f* includes a magnet for connecting the horizontal poles 506*a*-506*c*. A neodymium magnet is attached to the top of each of the vertical poles 504*a*-504*f*. The horizontal poles 506*a*-506*c* have 16 mm steel balls on each end that snap to the magnet but break away when stressed. When the portable jobsite spray booth 600 is assembled and is used for painting, drying, finishing, routing, sanding, and sawing, and for other processing purposes, the portable jobsite spray booth 600 is covered with the plastic frame from 5 sides with one side kept open. The disposable 5-sided clear plastic liner provides overspray protection to the ceiling, floor, and three sides and work object protection from external elements. The liner is easily/inexpensively replaced for new projects. The portable jobsite spray booth 600 includes high quality, durable aluminum extrusion frame and support poles. The portable jobsite spray booth 600 is provided with ventilation attachment that accommodates air filter, ducting and blower system. No-tools are required and only one-person can perform the assembly of the portable jobsite spray booth 600 in about 15 minutes. The dimensions of the portable jobsite spray booth 600 is 2 m (80")×2 m (80")×2 m (80"). The portable jobsite spray booth 600 presented herein eliminates overspray worries so that users can work closer to the workpieces. The portable jobsite spray booth 600 helps in avoiding time-consuming plastic barrier/wall building or often needed touch up after tear down. Clear plastic liners of the portable jobsite spray booth 600 let in ambient or supplemental light. Filtered exhaust can be routed as required. Protects workpieces from particulates. Conveniently transports and stores away. The portable jobsite spray booth 600 presented herein further includes plastic flooring that eliminates any damage to the floor during painting, drying, finishing, routing, sanding, and sawing various objects.

Figure 7:
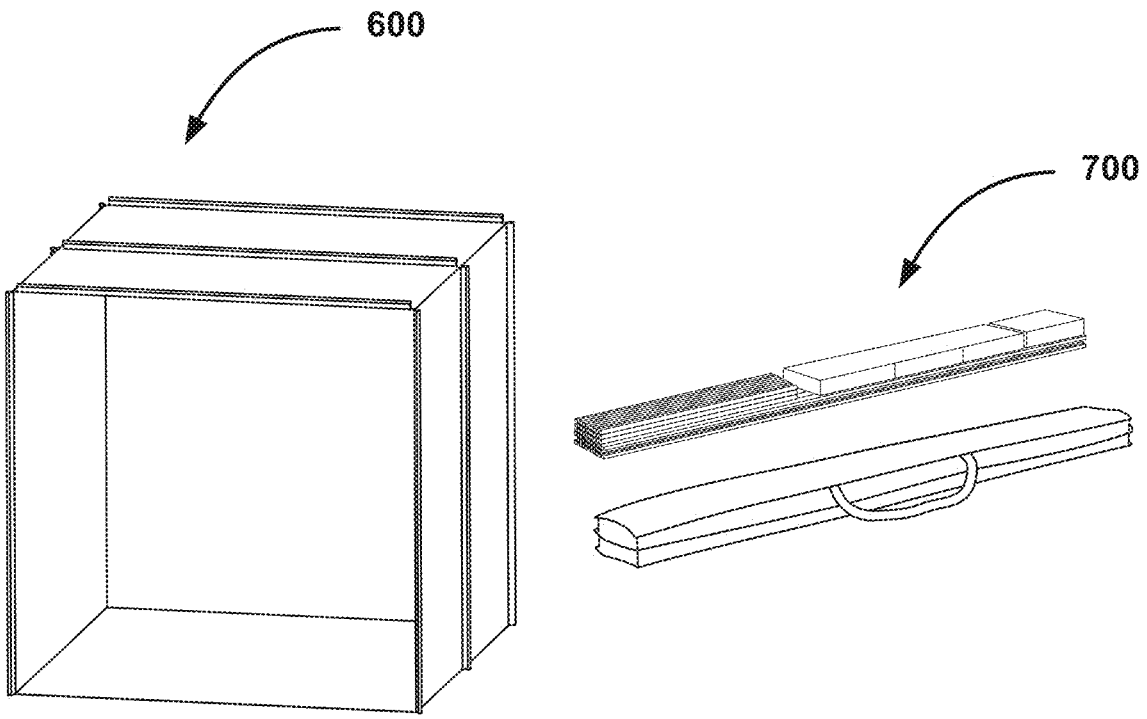
FIG. 7 shows the portable jobsite spray booth and a packaging bag for carrying various portable components of the portable jobsite spray booth, in accordance with an embodiment of the present invention.

FIG. 7 shows the portable jobsite spray booth 600 and a packaging bag 700 for carrying various portable components of the portable jobsite spray booth 600, in accordance with an embodiment of the present invention. The packaging bag 700 is a portable bag. The portable jobsite spray booth 600 quickly packs into the carry or storage bag (45 lbs.). Dimension of the packaging bag 700 is 80 inch length×7 inch breadth×5 inch height. The portable jobsite spray booth 600 has been designed for quick no tools assembly at a work site for processing an object and protecting the processed object. The processing of the object may include one or more of, but are not limited to, painting, drying, finishing, routing, sanding, and sawing.

Figure 8:
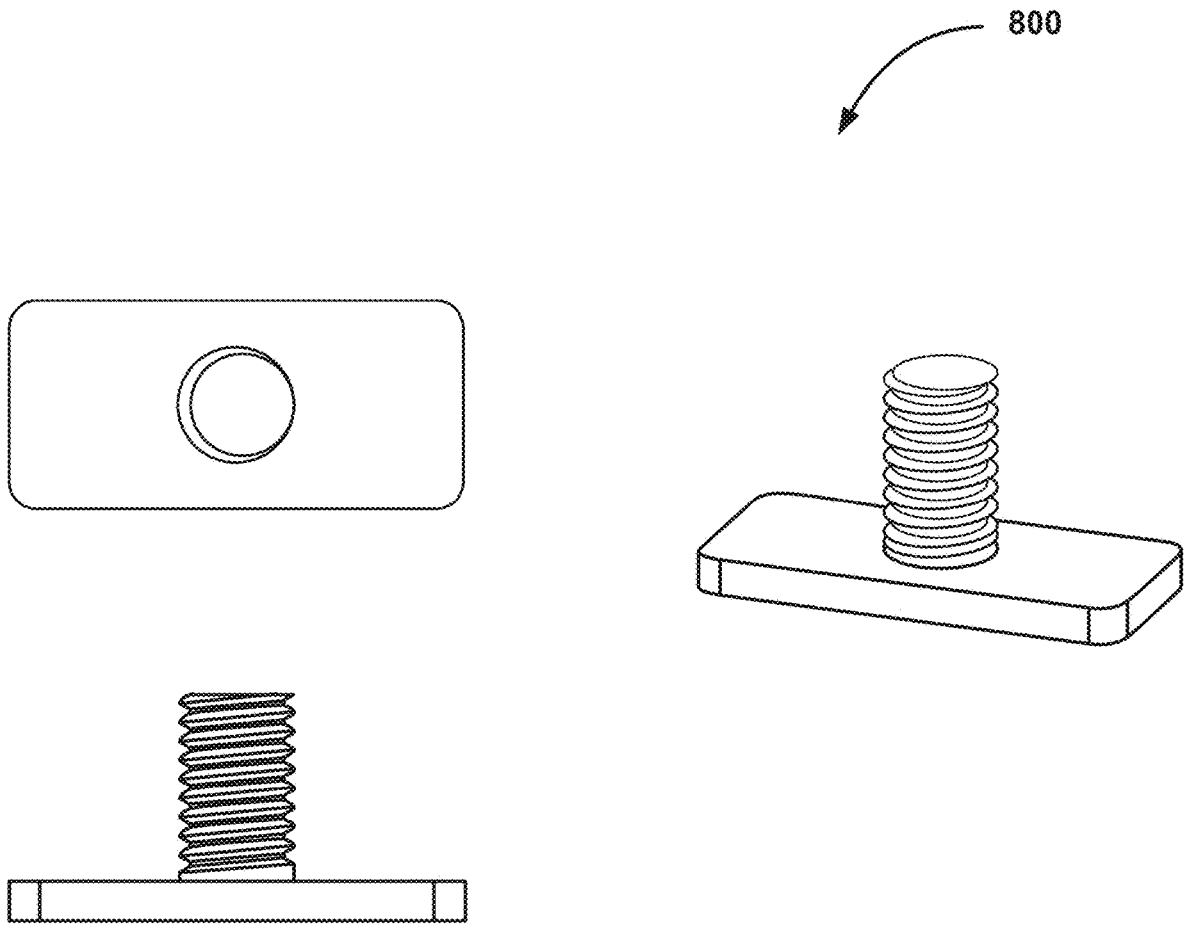
FIG. 8 shows a threaded nut and bolt assembly for use with the portable jobsite spray booth, in accordance with an embodiment of the present invention.

FIG. 8 shows a threaded nut and bolt assembly 800 for use with the portable jobsite spray booth 600, in accordance with an embodiment of the present invention. The threaded nut and bolt assembly 800 may be used for fastening the first connectors 100*a*-100*d* and the second connectors 300*a*-300*b* with the bases 502*a*-502*d*. For example, the threaded nut and bolt assembly 800 may be used for fastening the first connector 100*a* with the bases 502*a* and 502*d*. Similarly, the threaded nut and bolt assembly 800 may be used for fastening the second connector 300*a* with the base 502*d*.

Figure 9A:
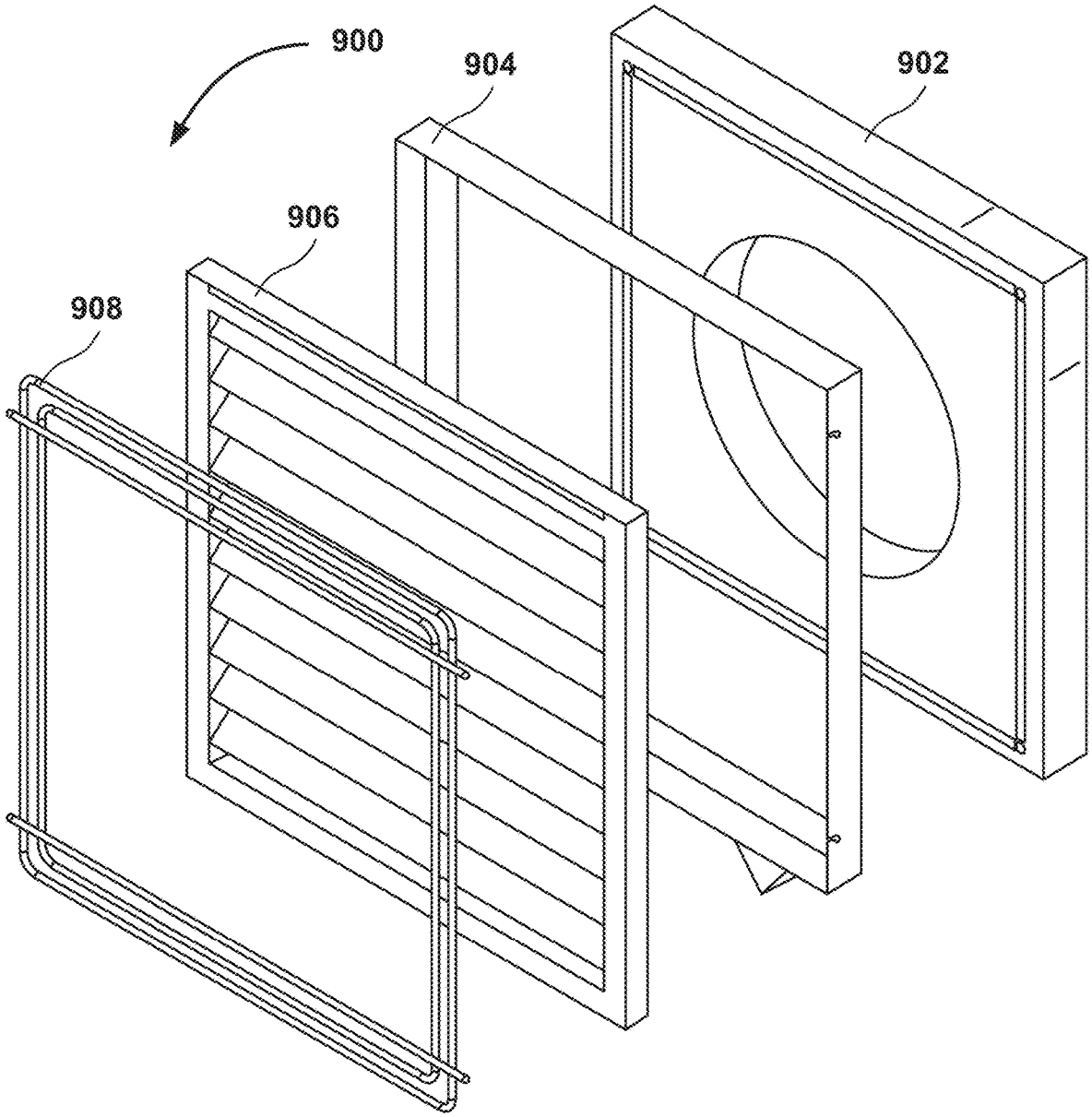
FIGS. 9A and 9B show various components of a vent assembly of the portable jobsite spray booth as viewed from different angles, in accordance with an embodiment of the present invention.
Figure 9B:
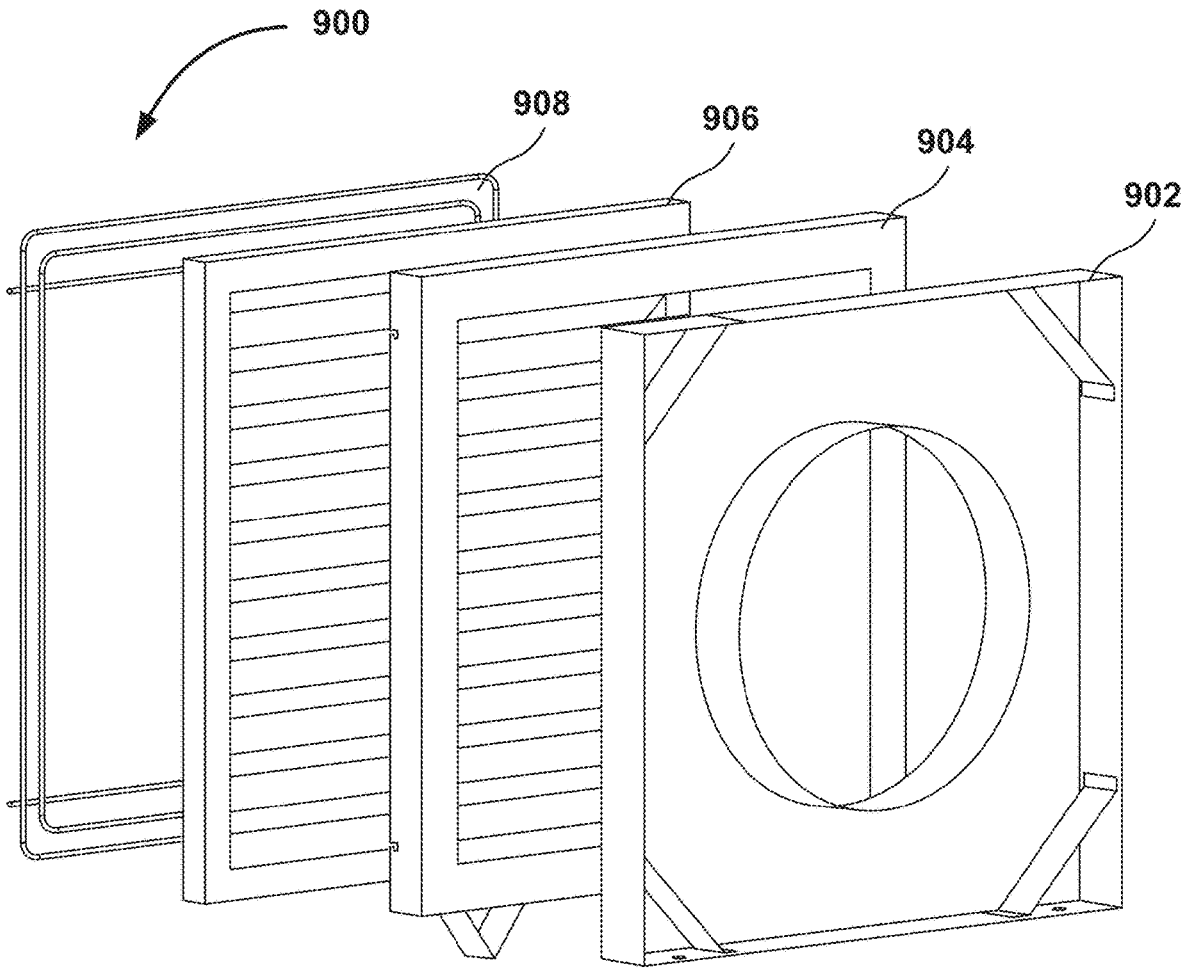

FIGS. 9A and 9B show various components of a vent assembly 900 of the portable jobsite spray booth 600 as viewed from different angles, in accordance with an embodiment of the present invention. The vent assembly 900 includes a main frame 902, a filter holder 904, a filter 906, and a vent window 908. The main frame 902 may be a duct attachment that is fitted with a vacuum plastic. The main frame 902 includes magnets and sealing strips that are glued in place on the duct attachment. The steel duct attachment bolts to the aluminum extrusion with the threaded tabs. From inside the portable jobsite spray booth 600, the steel filter holder 904 snaps in place to the magnets trapping the plastic liner. The rubber seals may be fitted over the vacuum plastic. The filter holder 904 is fitted over the rubber seas of the main frame 902, and finally, the filter 906 is fitted on the filter holder 904. The vent window 908 is used to cover the filter 906. Filtration and ventilation can be attached to the back of the portable jobsite spray booth 600. Exhaust blowers can then be attached via ducting to pull air through the portable jobsite spray booth 600 and through the filter 910. The portable jobsite spray booth 600 is provided with ventilation attachment that accommodates the air filter, ducting and blower system. In an exemplary embodiment, a hole is cut in the plastic liner, and then a 20"×20"×1" filter 906 is placed in the filter holder 904 and the wire guard is dropped into place to hold.

Figure 10:
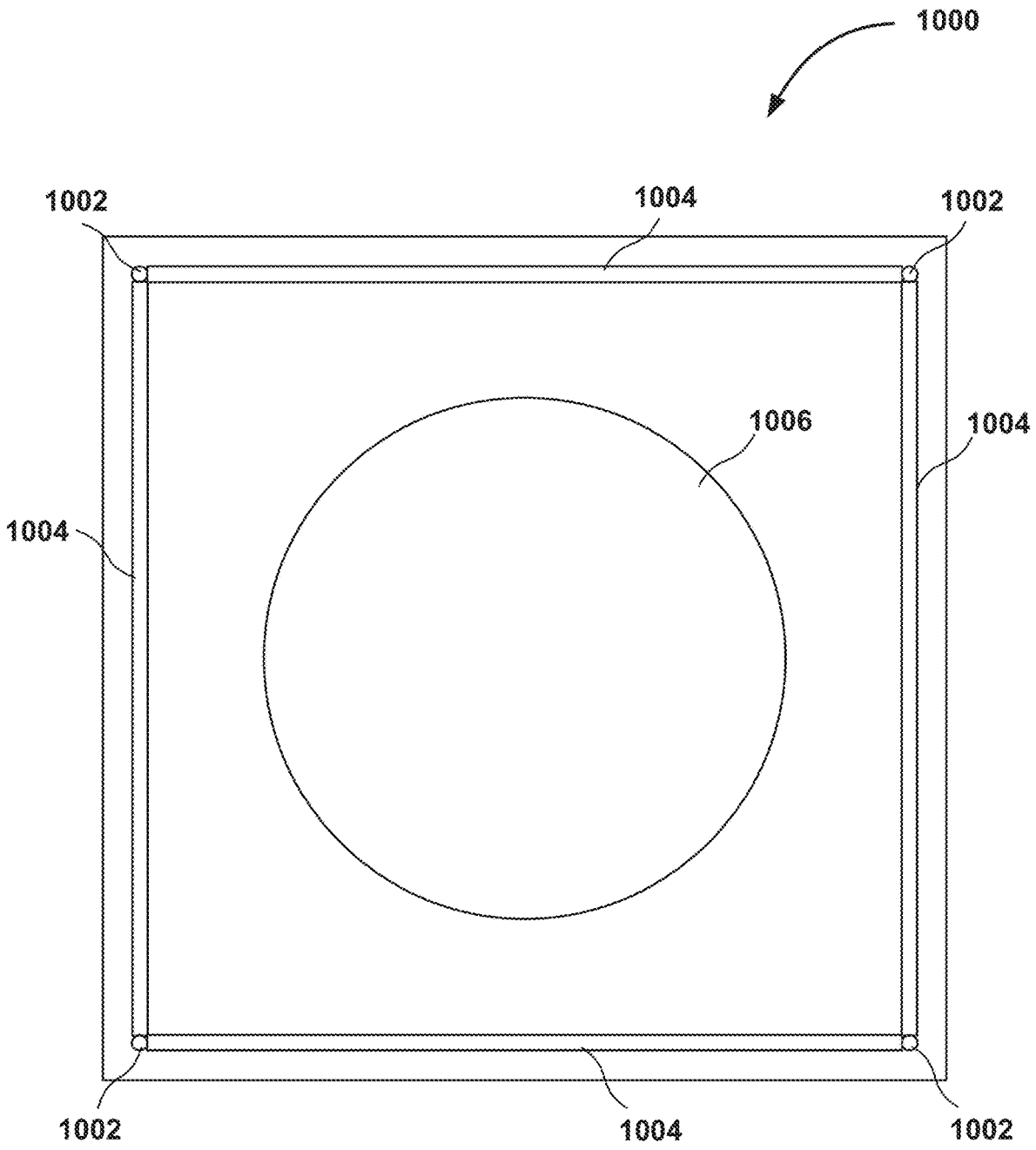
FIG. 10 shows a ducting attachment of the vent assembly that attaches to an aluminum extrusion as seen from inside of the portable jobsite spray booth, in accordance with an embodiment of the present invention.

FIG. 10 shows a ducting attachment 1000 of the vent assembly 900 that attaches to an aluminum extrusion as seen from inside of the portable jobsite spray booth 600, in accordance with an embodiment of the present invention. Here, the magnets 1002 (such as 4 circular neodymium magnets) and sealing strips 1004 are glued in place on the duct attachment 1000. The steel duct attachment 1000 bolts to the aluminum extrusion 1006 with the threaded tabs. From inside the portable jobsite spray booth 600, the steel filter holder 904 snaps in place to the magnets 1002 trapping the plastic liner. The ducting attachment 1002 attaches to the aluminum extrusion 1006 as seen from inside the portable jobsite spray booth 600. There are 4 circular neodymium magnets in the corners and rubber seal strips between the magnets to properly seal the connection. In an exemplary embodiment, length of the vent 900 (as seen from its side) is 7.5 inch. Length of each side of the vent 900 (as seen from its top) is 20.125 inch. Diameter of an outer hose of the vent 900 (as seen from its top) is 17.5 inch. Diameter of an inner hose of the vent 900 (as seen from its top) is 12.00 inch. The portable jobsite spray booth 600 is provided with ventilation attachment (i.e., the vent assembly 900) that accommodates air filter, ducting, and blower system.

Figure 11:
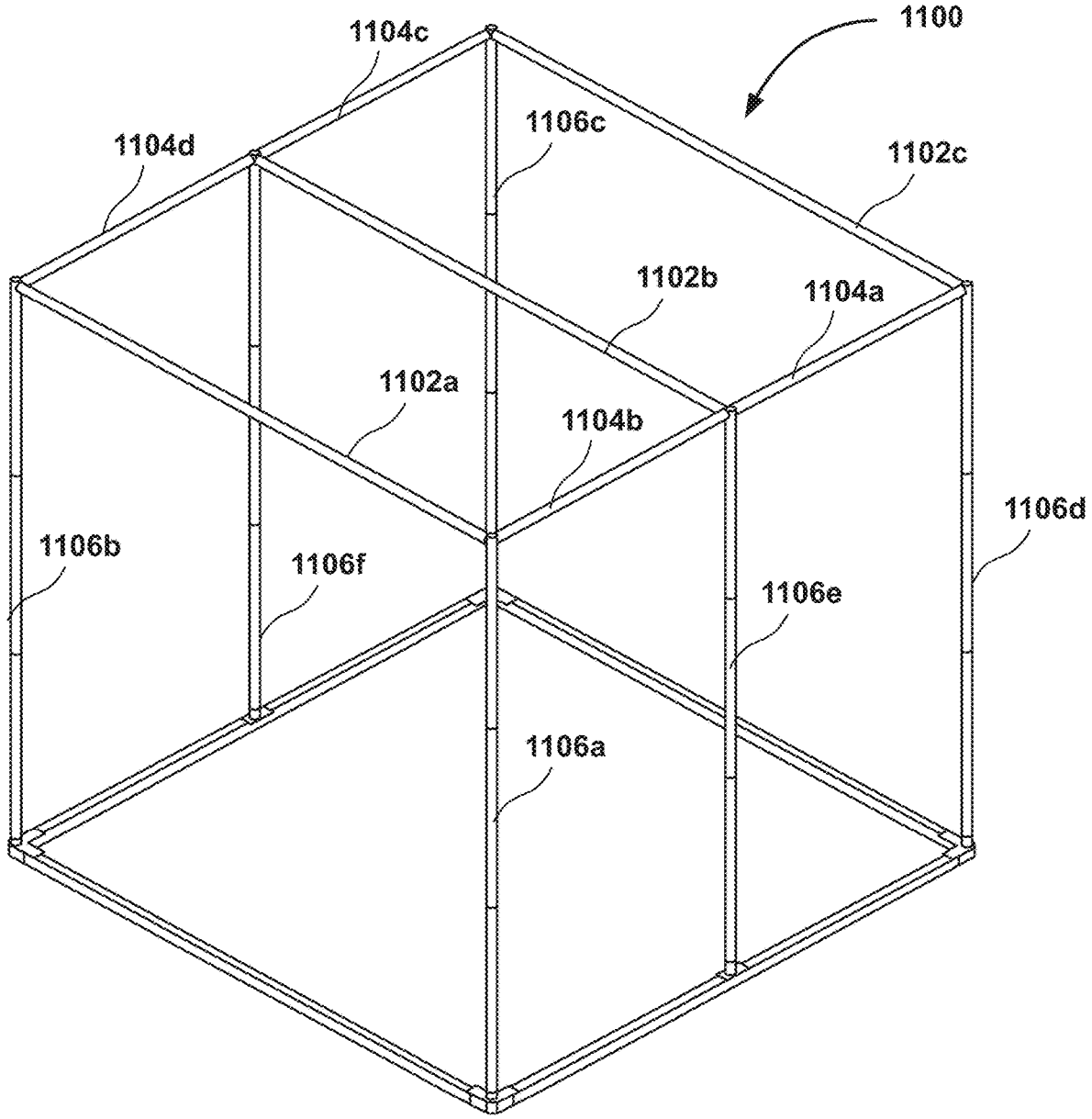
FIG. 11 shows an installed assembly of the portable jobsite spray booth, in accordance with an embodiment of the present invention.

FIG. 11 shows an installed assembly of the portable jobsite spray booth 1100, in accordance with an embodiment of the present invention. When the portable jobsite spray booth 1100 is assembled and is used for painting, drying, finishing, routing, sanding, and sawing, and other processes or work object protection purposes, the portable jobsite spray booth 1100 is covered with the plastic frame from 5 sides with one side kept open. The disposable 5-sided clear plastic liner provides overspray protection to the ceiling, floor, and three sides and work object protection from external elements. The liner is easily/inexpensively replaced for new projects. The portable jobsite spray booth 1100 includes high quality, durable aluminum extrusion frame and support poles. The portable jobsite spray booth 1100 is provided with ventilation attachment that accommodates air filter, ducting and blower system. No-tools are required and only one-person can perform the assembly of the portable jobsite spray booth 1100 in about 15 minutes. The dimensions of the portable jobsite spray booth 1100 is 2 m (80")×2 m (80")×2 m (80"). The portable jobsite spray booth 1100 presented herein eliminates overspray worries so that the users can work closer to the workpieces. The portable jobsite spray booth 1100 helps in avoiding time-consuming plastic barrier/wall building or often needed touch up after tear down. Clear plastic liners of the portable jobsite spray booth 1100 let in ambient or supplemental light. Filtered exhaust can be routed as required. Protects workpieces from particulates. Conveniently transports and stores away. The portable jobsite spray booth 1100 presented herein further includes plastic flooring that eliminates any damage to the floor during processing (such as painting, drying, finishing, routing, sanding, sawing, or the like) of various objects. The 2 m horizontal poles (such as the horizontal poles 1102*a*-1102*c*) thread through the liner hem. The 1 m horizontal poles (such as the horizontal poles 1104*a*-1104*d*) are on the outside of the liner to keep the liner from sagging. Each of the vertical poles 1106*a*-1106*f* includes a magnet for connecting the horizontal poles 1102*a*-1102*c* and 1104*a*-1104*d*. A neodymium magnet is attached to the top of each of the vertical poles 1106*a*-1106*f*. Each of the horizontal poles 1102*a*-1102*c* and 1104*a*-1104*d* has 16 mm steel balls on each end that snap to the magnet but break away when stressed.

Figure 12:
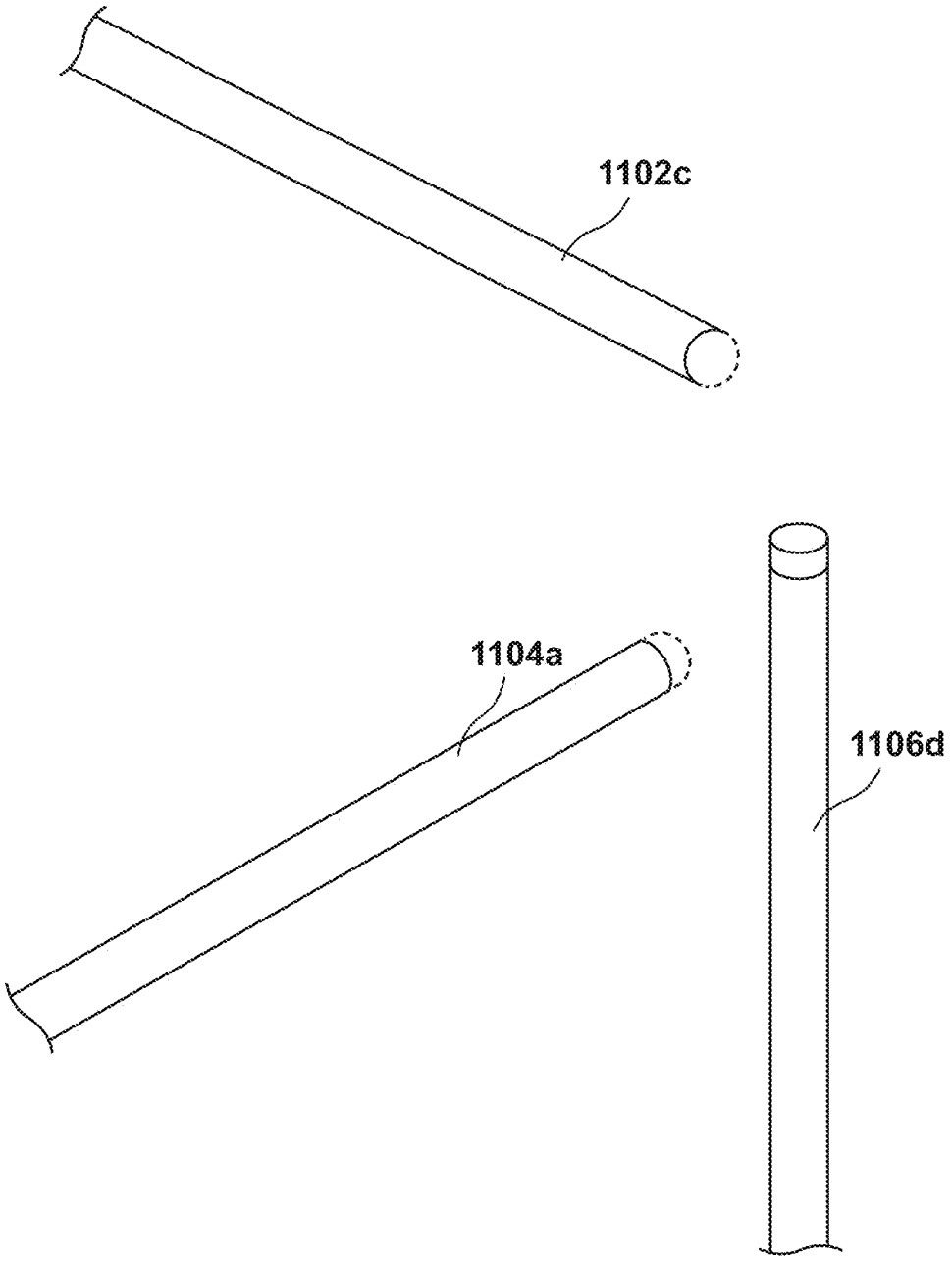
FIG. 12 shows horizontal and vertical poles of the portable jobsite spray booth, in accordance with an embodiment of the present invention.

FIG. 12 shows horizontal and vertical poles of the portable jobsite spray booth 1100, in accordance with an embodiment of the present invention. The vertical pole 1106*d* includes a magnet for connecting the horizontal poles the horizontal poles 1102*c* and 1104*a*. A neodymium magnet is attached to the top of each of the vertical pole 1106*d*. Each of the horizontal poles 1102*c* and 1104*a* has 16 mm steel balls on each end that snap to the magnet but break away when stressed.

Figure 13:
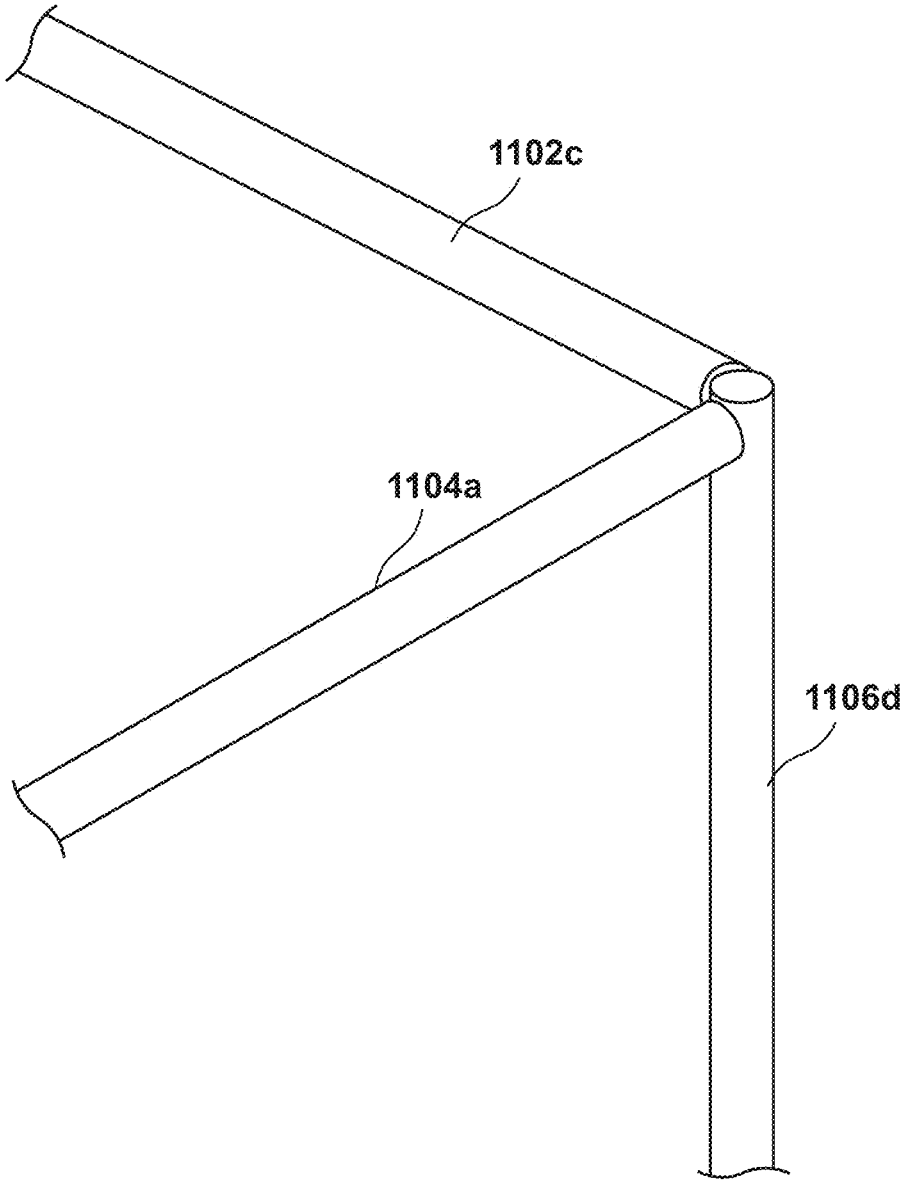
FIG. 13 shows the horizontal and vertical poles that are connected to each other, in accordance with an embodiment of the present invention.

FIG. 13 shows the horizontal poles 1102*c* and 1104*a* and the vertical pole 1106*d* that are connected to each other, in accordance with an embodiment of the present invention. The horizontal poles 1102*c* and 1104*a* and the vertical pole 1106*d* are connected by means of a magnetic mechanism by using the neodymium magnet included in the vertical pole 1106*d* and the 16 mm steel balls included in the horizontal poles 1102*c* and 1104*a*.

Figure 14:
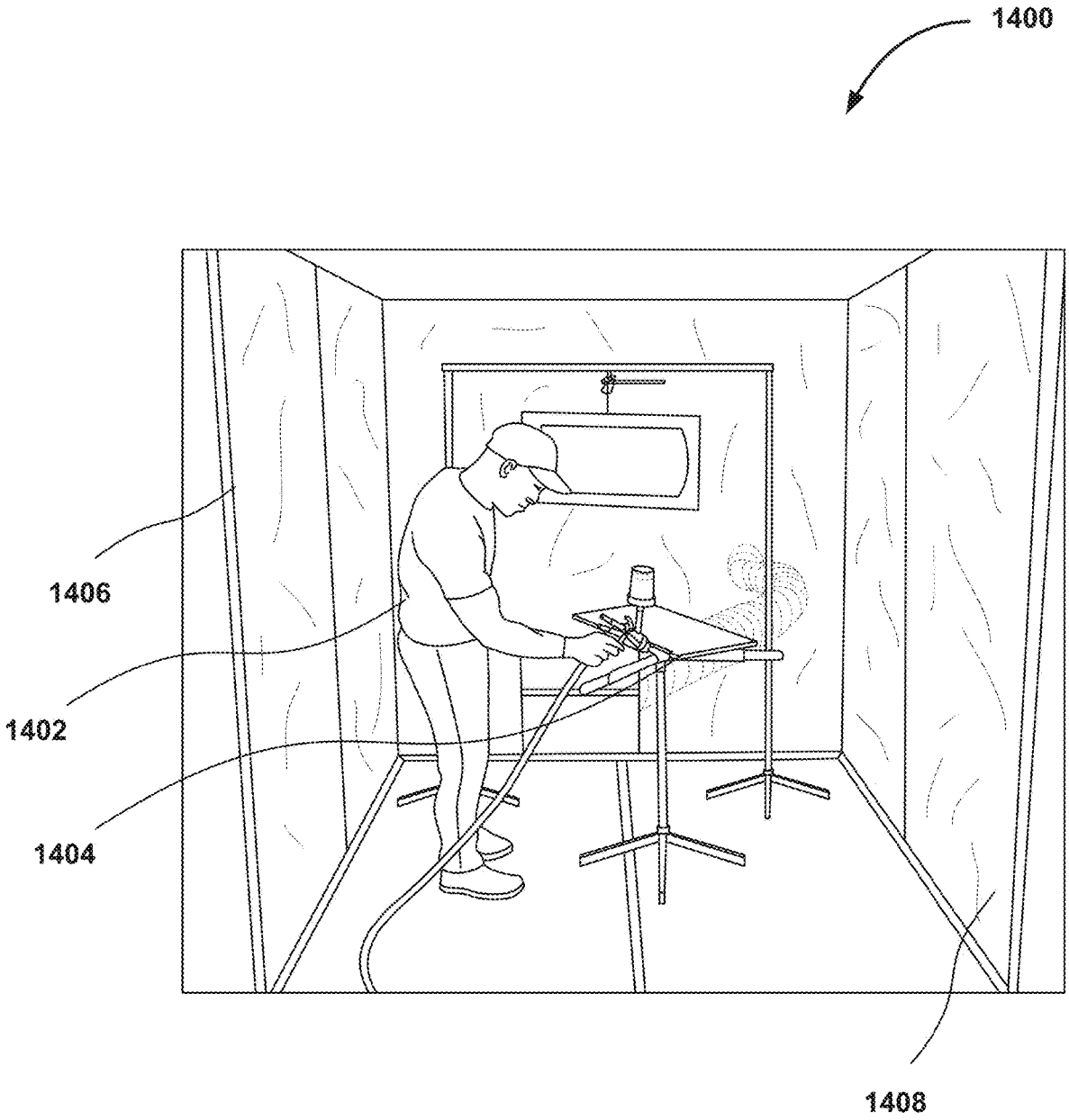
FIG. 14 shows an exemplary working environment in which a painter is painting an object inside the portable jobsite spray booth, in accordance with an embodiment of the present invention.

FIG. 14 shows an exemplary working environment 1400 in which a user 1402 is painting or finishing an object 1404 inside the portable jobsite spray booth 1406, in accordance with an embodiment of the present invention. The portable jobsite spray booth 1406 uses the disposable plastic liners 1408 to protect the jobsite while spraying non-flammable and non-combustible finishes. This walk-in, open-faced booth 1406 sets up in minutes and packs into a carry bag (such as the portable bag 700) for easy transport between jobs. When the portable jobsite spray booth 1406 is assembled and is used for painting or drying purposes, the portable jobsite spray booth 1406 is covered with the plastic frame (i.e., the disposable plastic liners 1408) from 5 sides with one side kept open. The disposable 5-sided clear plastic liner provides overspray protection to the ceiling, floor, and three sides. The liner is easily/inexpensively replaced for new projects. The portable jobsite spray booth 1406 includes high quality, durable aluminum extrusion frame and support poles. The portable jobsite spray booth 1406 is provided with a ventilation attachment that accommodates the air filter, ducting and blower system. No-tools are required and only one-person can perform the assembly of the portable jobsite spray booth 1406 in about 15 minutes. The dimensions of the portable jobsite spray booth 1406 are 2 m (80")×2 m (80")×2 m (80"). The portable jobsite spray booth 1406 presented herein eliminates overspray worries so that the users can work closer to the workpieces. The portable jobsite spray booth 1406 helps in avoiding time-consuming plastic barrier/wall building or often needed touch up after tear down. Clear plastic liners of the portable jobsite spray booth 1406 let in ambient or supplemental light. Filtered exhaust can be routed as required. Protects workpieces from particulates. Conveniently transports and stores away. The portable jobsite spray booth 1406 presented herein further includes plastic flooring that eliminates any damage to the floor during painting, drying, finishing, or processing various objects such as the object 1404.

Although the present invention has been described with respect to the portable jobsite spray booth 500, 600, 1100, or 1406, it should be understood that the proposed portable jobsite spray booth can be formed with varying shapes and sizes, and thus the disclosure here should not be considered limited to the exemplary embodiments and processes described herein. The various dimensions may be modified to fit in specific application areas.

Although particular embodiments of the invention have been described in detail for purposes of illustration, various modifications and enhancements may be made without departing from the spirit and scope of the invention.

What is claimed is:

1. A portable jobsite spray booth, comprising:
a plurality of bases,
a plurality of first connectors,
a plurality of second connectors,
a plurality of vertical poles,
a plurality of first type of horizontal poles, and
a plurality of second type of horizontal poles,
wherein each pair of the plurality of bases are connected to each other at a right angle by using a first connector of the plurality of first connectors,
wherein each vertical pole of the plurality of vertical poles is connected to at least one of a respective first connector of the plurality of first connectors or a respective second connector of the plurality of second connectors,
wherein each of the plurality of first type of horizontal poles and each of the plurality of second type of horizontal poles are connected to a top end of each of plurality of vertical poles by means of a magnetic mechanism, and a length of the plurality of first type of horizontal poles is greater than a length of the plurality of second type of horizontal poles,
wherein the magnetic mechanism is implemented by using a neodymium magnet that is attached to top of each vertical pole of the plurality of vertical poles, and
wherein a disposable plastic liner is used for covering five sides of the portable jobsite spray booth with one side open.

2. The portable jobsite spray booth of claim 1, wherein each base includes a rectangular hollow path for placing at least one of the plurality of first connectors and the plurality of second connectors.

3. The portable jobsite spray booth of claim 1, wherein each first connector is a removable fastener or bracket that is used to connect two bases of the portable jobsite spray booth at their edges in a L-shaped manner.

4. The portable jobsite spray booth of claim 3, wherein each first connector includes two circular holes that are used for fastening two bases together by means of a nut-bolt assembly.

5. The portable jobsite spray booth of claim 3, wherein each first connector includes a pipe connector that is used for connecting each vertical pole of the plurality of vertical poles.

6. The portable jobsite spray booth of claim 3, wherein each first connector includes two base fixing components that protrude inward below a L-shaped base of each first connector, wherein the two base fixing components are used for removably securing two bases of the portable jobsite spray booth.

7. The portable jobsite spray booth of claim 1, wherein each second connector includes a circular hole that is used for fastening each second connector with a respective base of the spray both by means of a nut-bolt assembly.

8. The portable jobsite spray booth of claim 1, wherein each second connector includes two base fixing components that protrude inward below a rectangular base of each second connector, and wherein the two base fixing components are used for removably securing each second connector along a rectangular hollow path of a base of the portable jobsite spray booth.

9. The portable jobsite spray booth of claim 1, further comprising a vent assembly that includes a duct attachment, a filter holder, a filter, and a vent window, wherein the vent assembly facilitates filtration and ventilation to the portable jobsite spray booth with a ventilation attachment that accommodates air filter, ducting and blower system.

10. The portable jobsite spray booth of claim 9, wherein magnets and sealing strips are glued in place on the duct attachment, and wherein the duct attachment bolts to an aluminum extrusion with threaded tabs.

11. The portable jobsite spray booth of claim 10, wherein a steel filter holder snaps in place to the magnets trapping the plastic liner.

12. The portable jobsite spray booth of claim 1, wherein each of the horizontal poles includes steel balls on each end that snap to magnet and break away when stressed.

13. The portable jobsite spray booth of claim 1, wherein the disposable plastic liner is used to protect a jobsite while spraying non-flammable and non-combustible finishes.

14. The portable jobsite spray booth of claim 13, wherein the disposable plastic liner provides overspray protection to ceiling, floor, and three sides of a workspace.

15. The portable jobsite spray booth of claim 1, wherein the vertical poles and horizontal poles are aluminum tent poles that support the disposable plastic liner.

16. The portable jobsite spray booth of claim 1, wherein the aluminum poles slide through hems that are outside the disposable plastic liner so that the disposable plastic liner is completely enclosed and doesn't allow contamination to the workspace.

17. The portable jobsite spray booth of claim 1, wherein each of the plurality of first type of horizontal poles and each of the plurality of second type of horizontal poles are connected to a top end of each of plurality of vertical poles by means of a single-pole joint.

18. A portable jobsite spray booth, comprising:
a plurality of bases,
a plurality of first connectors,
a plurality of second connectors,
a plurality of vertical poles,
a plurality of first type of horizontal poles,
a plurality of second type of horizontal poles, and
a vent assembly,
wherein each pair of the plurality of bases are connected to each other at a right angle by using a first connector of the plurality of first connectors,
wherein each vertical pole of the plurality of vertical poles is connected to at least one of a respective first connector of the plurality of first connectors or a respective second connector of the plurality of second connectors,
wherein each of the plurality of first type of horizontal poles and each of the plurality of second type of horizontal poles are connected to a top end of each of plurality of vertical poles by means of a magnetic mechanism, and a length of the plurality of first type of horizontal poles is greater than a length of the plurality of second type of horizontal poles, wherein a disposable plastic liner is used for covering five sides of the portable jobsite spray booth with one side open, wherein the vent assembly includes a duct attachment, a filter holder, a filter, and a vent window, wherein the vent assembly facilitates filtration and ventilation to the portable jobsite spray booth with a ventilation attachment that accommodates air filter, ducting and blower system, and wherein magnets and sealing strips are glued in place on the duct attachment, and wherein the duct attachment bolts to an aluminum extrusion with threaded tabs.

* * * * *